US005213030A

United States Patent [19]

Bolstad

[11] Patent Number: 5,213,030

[45] Date of Patent: May 25, 1993

[54] METHOD FOR PACKAGING AND SHIPPING FIBER MATERIALS

[75] Inventor: Clifford R. Bolstad, Milton, Wash.

[73] Assignee: Weyerhaeuser Company, Tacoma, Wash.

[21] Appl. No.: 939,100

[22] Filed: Sep. 1, 1992

Related U.S. Application Data

[62] Division of Ser. No. 607,265, Oct. 31, 1990, Pat. No. 5,174,198.

[51] Int. Cl.[5] ..... B30B 13/00

[52] U.S. Cl. ..... 100/35; 100/3; 100/179; 206/83.5; 428/359

[58] Field of Search ..... 100/1-3, 100/7, 17, 18, 19 R, 35, 179, 188 R, 189; 206/83.5; 428/359-362

[56] References Cited

U.S. PATENT DOCUMENTS

| | | | |
|---|---|---|---|
| 2,037,211 | 4/1936 | Campbell | 100/3 |
| 2,341,370 | 2/1944 | Fourness et al. | 100/3 |
| 2,647,285 | 8/1953 | Pfau | 100/3 X |
| 3,895,572 | 7/1975 | Nitschke | 100/35 |
| 4,002,004 | 1/1977 | Lambert | 100/35 X |
| 4,162,603 | 7/1979 | Strömberg | 100/3 X |
| 4,167,902 | 9/1979 | Bister et al. | 100/3 |
| 4,287,823 | 9/1981 | Thompson . | |
| 4,453,461 | 6/1984 | Fleissner . | |
| 4,477,515 | 10/1984 | Masuda et al. | 428/359 X |
| 4,526,094 | 7/1985 | Rewitzer | 100/35 |
| 4,599,939 | 7/1986 | Fleissner . | |
| 4,746,011 | 5/1988 | McNair, Jr. et al. | 206/83.5 |
| 4,822,453 | 4/1989 | Dean et al. . | |
| 4,848,222 | 7/1989 | Fleissner | 100/35 |
| 4,884,682 | 12/1989 | Weder et al. | 206/83.5 |
| 4,942,719 | 7/1990 | Fleissner . | |
| 4,959,948 | 10/1990 | Fleissner . | |

FOREIGN PATENT DOCUMENTS

| | | | |
|---|---|---|---|
| 0399564 | 11/1990 | European Pat. Off. . | |
| 264648 | 2/1989 | Fed. Rep. of Germany . | |
| 777113 | 6/1957 | United Kingdom | 100/3 |

*Primary Examiner*—Stephen F. Gerrity
*Attorney, Agent, or Firm*—Klarquist, Sparkman, Campbell, Leigh & Whinston

[57] ABSTRACT

Restrained bales are formed for transporting high-bulk, crosslinked cellulose fiber in a reduced volume. A limited amount of force is used in compressing the fiber into the bales so that the fiber is not damaged. The limited amount of force used allows the bale, when restraints are released, to expand to about twice its restrained volume. Fiber damage is further minimized by limiting the amount of compression to the minimum required so that a transport container is completely filled to its volume and payload capacities.

2 Claims, 3 Drawing Sheets

METHOD FOR PACKAGING AND SHIPPING FIBER MATERIALS

This is a division of application Ser. No. 07/607,265, filed Oct. 31, 1990, (U.S. Pat. No. 5,174,198).

BACKGROUND OF THE INVENTION

This invention relates to the baling of fiber and methods of forming such bales to facilitate shipment. The invention further relates to a method of forming bales having specific densities and dimensions so that a plurality of the bales will substantially fully occupy the interior volume of a transport and will substantially fully equal the maximum payload of the transport.

Cellulose fiber is an exceptionally useful material in the textile and other industries. It is widely used in highly absorbent products such as diapers. Fibrous material made by the procedure and apparatus described in co-pending application filed Oct. 31, 1990 entitled "Fiber Treatment Apparatus" to Allen R. Carney et al, application Ser. No. 07/607,268 (pending) (incorporated herein by reference) are particularly valuable.

It is frequently necessary to transport the fiber material from the side where it is manufactured to the location where it is to be used. This presents a problem because the fiber is very bulky, particularly if manufactured by a preferred method wherein fiber is maintained in substantially individual form during drying and crosslinking steps. Shipping such a material would be prohibitively expensive unless it could first be reduced in volume.

One method for transporting bulk cellulose fiber would be to form densified sheets which could be more easily handled and tightly packed in a trailer, shipping container, or rail car. According to U.S. Pat. No. 4,822,453, is difficult to form densified sheets of dry crosslinked fibers. When sheets of such material are refluffed, it is found that the fibers have been damaged and that nowhere near the full bulk of the original fibers can be restored. One consequence of compressing the fibers with pressures sufficient to form densified sheets is the fiber's subsequent inability to regain its prior absorbency. The resiliency of crosslinked fiber makes it particularly difficult to form sheets of that material without damaging the fiber.

Another option would be to crush the fiber material into freestanding bales. Vertical presses are capable of compressing high-bulk fiber having an initial density of about 0.008 g/cc to a final freestanding or unrestrained density of 0.41 g/cc or more. Final freestanding bale densities of about 0.41 g/cc would be required to maintain the high-bulk, crosslinked cellulose fiber in the shape of a bale, following retraction of a bale press, without the use of bale restraints. But, such bales would have the same shortcomings as sheets. A great deal of force must be applied to produce freestanding bales of meaningfully increased density. The fiber is damaged during compression and cannot thereafter be restored to anywhere near full volume or absorbency. For example, tests indicate that compressing such fiber to a freestanding bale which maintains a density of about 0.41 g/cc results in a 43% loss in bulk.

Certain bulk materials, such as hay, are formed into restrained bales for transport. Balers are currently available to form restrained bales of paper products or paper waste products such as old corrugated containers (o.c.c.). For example, Maren Engineering Corporation manufactures an automatic baler capable of continuously forming bales of o.c.c. and other paper products. The operating pressure of the Maren baler, model number 203, is approximately 155 kgs/square centimeter. The application of this pressure can produce compressed densities of about o.c.c. to 0.48 g/cc for certain materials. Other examples of prior art balers used for baling o.c.c. and paper waste products are available from C & M Baler Company of Winston-Salem, N.C. No one has heretofore thought to use such balers for baling high-bulk resilient fibers.

SUMMARY OF THE INVENTION

Optimally, one would like to have bales of resilient high-bulk, crosslinked fiber that, when they reach their destination, could provide fiber with nearly the same bulkiness as the fiber prior to its compression.

Accordingly, this invention concerns a method for forming resilient high-bulk, crosslinked cellulose fiber into restrained bales of particular densities wherein the requisite compression force does not harm the fiber. When released, bales according to the present invention expand to nearly double their original volume. And, physical properties of fiber in such bales are not altered by the baling process.

Another aspect of this invention is a method for forming bales of high-bulk material having preselected densities and dimensions wherein a plurality of the bales will occupy substantially the entire interior volume and payload of various transports. The payload and interior volume of a transport is an integral multiple of the volume and density of the restrained bales. Bales are formed to be of the lowest possible density while making the most efficient use of a transport's volume and payload capacities.

According to a preferred embodiment of the present invention, a baler can be used to automatically and continuously form high-bulk, crosslinked cellulose fiber into restrained bales of desired dimensions. High-bulk cellulose fiber is introduced into a load hopper having both a top and bottom orifice through which the fiber is funneled into a bale chute. The bale chute is constructed with both height and width dimensions essentially equal to the final dimensions of the restrained bales.

Once the high-bulk cellulose fiber has been introduced into the bale chute, a bale press, comprised of a press platen and ram, is activated to compress and extrude the material through a bale chute to achieve the desired bale length and density.

As the bale is extruded, the leading edge of the bale engages a plurality of restraints. The restraints are aligned at regular intervals across the open end of the bale chute through which the newly forming bale travels. As the bale is extruded through the bale chute, the plurality of restraints are drawn at regular intervals along the edges of the bale.

When enough material has been compressed to form a bale of desired length and density, a threading device engages the restraints along the backside of the bale. The threading device carries the restraints from the backside of the bale through the interior of the press platen and aligns the restraints of the backside of the bale with the restraints on the frontside.

Threading the restraints in this manner, in conjunction with the formation of a fourth edge of the bale by the face of the platen, results in encircling the bale with restraints while maintaining the pressure applied by the press platen. Once the restraints have been aligned, the restraints are thereafter severed and intertwined. In this manner, restrained bales of desired densities and dimensions are continuously produced.

Restraining the bales while maintaining the pressure applied by the platen allows compression of the fibers with lower compression forces than unrestrained bales. By using such restrained bales, the original bulk characteristic of the fiber is substantially preserved.

The bale length and restrained density of the bale can be varied so that an integral number of the bales will substantially occupy the interior volume of a transport payload.

DETAILED DESCRIPTION

Figure 1:
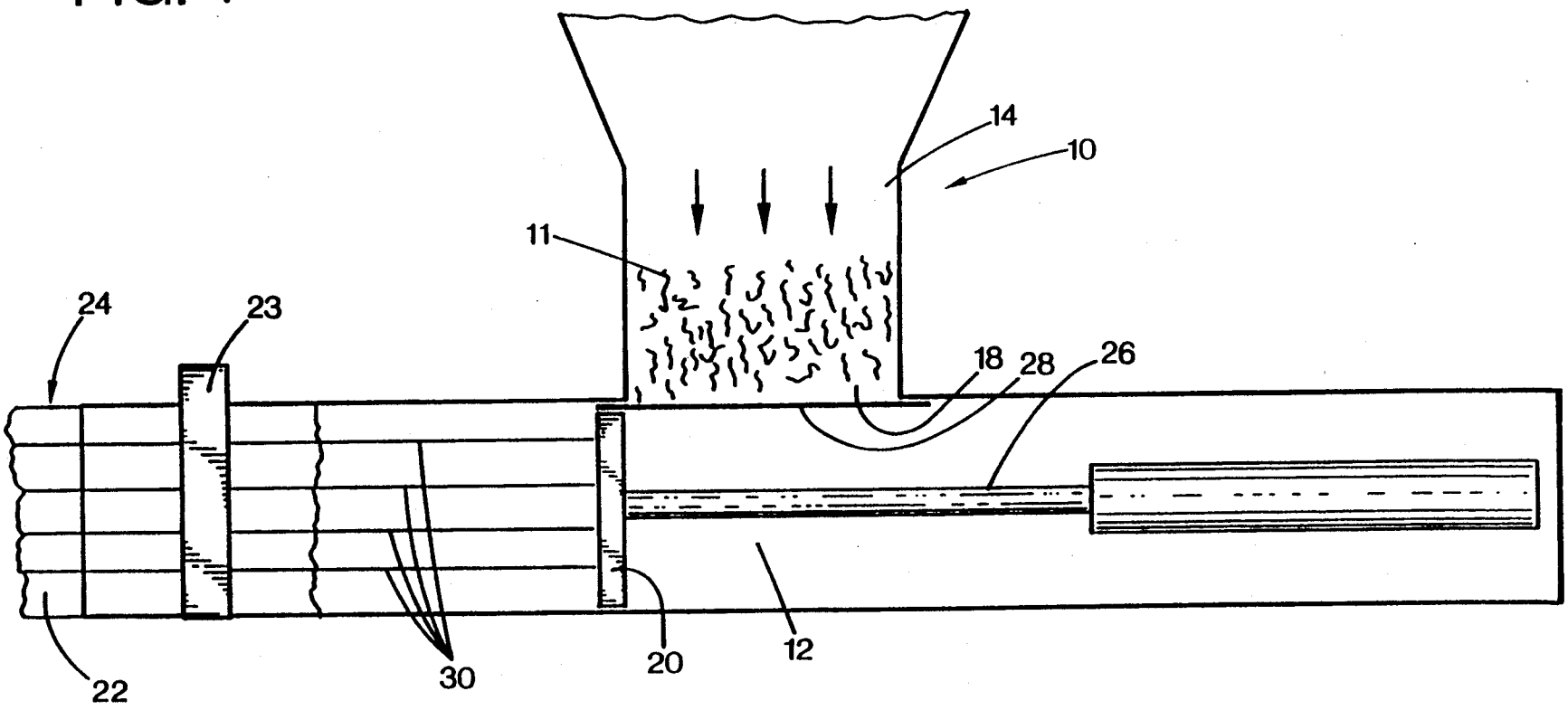
FIG. 1 is a schematic side elevational view of a baler suitable for use in methods of the invention.
Figure 2:
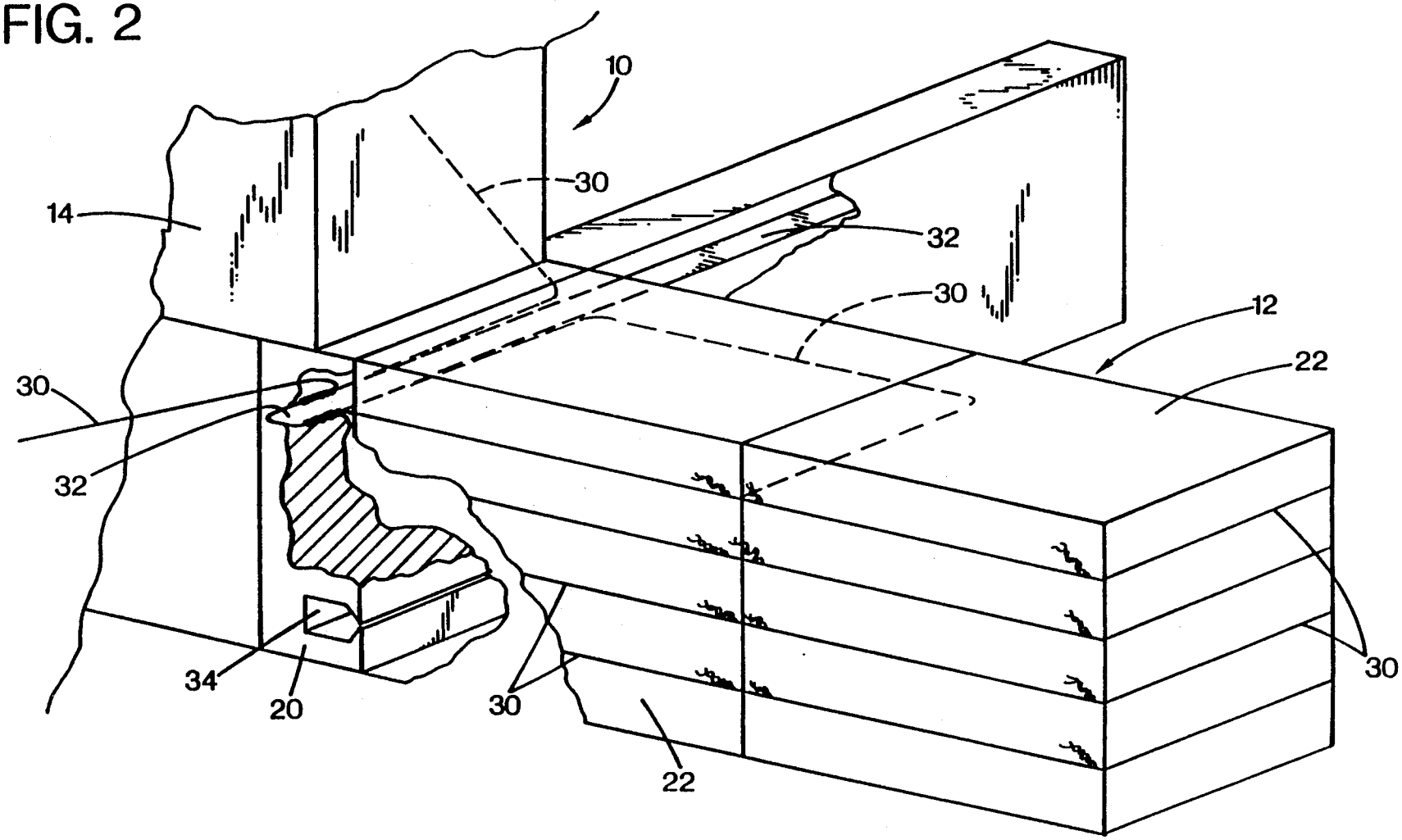
FIG. 2 is a schematic oblique view of the baler of FIG. 1, showing a bale being tied.

For the purpose of this application, "high-bulk, crosslinked cellulose fiber" is a highly absorbent material which contains individualized, crosslinked cellulose fibers. The material has between about 0.8 mole and about 8.0 mole % crosslinking agent, calculated on a cellulosic anhydroglucose molar basis, reacted with the fibers in an intrafiber crosslink bond form. The bulk of such material is between about 5.0 cc/g and about 30.0 cc/g.

The bulk level was determined by the following procedure, involving production of test "handsheets" having a diameter of about 6 inches:

A "British handsheet mold" was filled with 3 to 4 inches of water. To approximately 750 mL of water were added 1.2 g of NB-316 pulp, a conventional southern softwood craft pulp available from Weyerhaeuser Company, followed by agitation using a Waring blender for 20 seconds to yield a fiber slurry. A 2.4-gram sample of high-bulk, crosslinked fiber was added to the pulp slurry in the blender followed by agitation therein for another 10 seconds. The resulting slurry was added to the handsheet mold up to a fill mark. The slurry in the mold was gently mixed using a spatula for 3 seconds, then drained, leaving the pulp wet laid on the screen in the mold. The wet pulp layer was blotted to remove as much moisture as possible, then removed from the screen. The resulting handsheet was dried between two blotters on a drum dryer, then weighed to the nearest 0.01 gram immediately after drying.

Bulk was determined using a caliper, performed immediately after drying. Mean thickness was determined using five thickness determinations of various locations on the handsheet. Bulk was calculated in units of $cm^3/g$ as follows:

$$\frac{(\text{mean thickness in mm})\ (20.38\ cm^2)}{(\text{Handsheet weight grams})} = \text{Bulk}$$

FIG. 1 is a side view of a bale press 10 useful in the process of the present invention. The press 10 compresses and extrudes high-bulk, crosslinked cellulose fiber (hereinafter "fiber") 11 through a bale chute 12.

The fiber is delivered via a load hopper 14, having both top and bottom orifices 16, 18. The hopper 14 funnels the resilient high-bulk cellulose fiber 11 into bale chute 12 for subsequent compression by a platen 20. The initial density of a preferred cellulose fiber entering the bale chute 12 via the load hopper 14 is approximately 0.008 g/cc; however, the exact initial density of the material entering the bale chute may vary between about 0.05 g/cc and about 0.012 g/cc.

Once the high-bulk fiber has been funneled into bale chute 12, the bale press 10 thereafter applies pressure sufficient to compress the fiber into a bale 22 of desired density and then, after the bale 22 is secured, ejects it through an open end 24 of the bale chute 12. A preselected side pressure is maintained on the forming bale 22 by a tension ram 23 so that bales 22 have uniform final dimensions and density.

In a preferred embodiment, a bale press ram 26 is used to apply to platen pressure sufficient to compress the fiber to a variable second density having an upper limit of about 1.0 g/cc. The platen pressure required to from a bale from fiber having an initial density of 0.08 g/cc to a final density equal to 1.0 g/cc is approximately 42.7 $kgs/cm^2$ (600 psi). Due to the restrained nature of the bale during pressing and by restraints applied (as described below) to the bale while restrained, densities of 1.0 g/cc can be obtained without requiring the extremely high pressures of prior art vertical presses. The illustrated press 10 is capable of delivering a maximum desired pressure of 42.7 kgs/square centimeter to the high bulk fiber. Above the pressure, fiber damage due to crushing of the fibers becomes a significant problem. However, optimum results are obtained when the compression force is about 7.0–10.5 $kgs/cm^2$.

Generally, the second density of the fiber should be 0.1–0.3 g/cc, wherein the preferred density range is 0.2–0.3 g/cc. When operating in these ranges, a restrained bale 22 about doubles in volume upon release of its restraints. In particular, tests indicate that compressing the fiber to second densities of 0.12–0.30 g/cc allows the fiber to regain approximately 1.7 times the restrained volume following release of the bale restraints. Compressing the fiber to densities greater than 1.0 g/cc decreases the bulk regained by the fiber following release of restraints encircling the bales. In addition, increasing the density above this level has deleterious effects on the internal bond characteristics of the fiber.

A most favorable embodiment of the invention involves compressing the fiber to a second density of 0.31 g/cc and then restraining the fiber as a bale. After the bale is ejected from the baler, the final density of the restrained bale is about 0.28 g/cc. A bale produced in this manner, having a density of 0.28 g/cc and final dimensions of about 0.67 by 0.77 by 1.15 meters, exerts an expansion force on the restraints of approximately 113 kilograms.

The amount of high-bulk fiber entering bale chute 12 is controlled by periodically interrupting the flow of material entering the chute by means of platen press gate member 28. Platen press gate member 28 obstructs the bottom orifice 18 of load hopper 14 as the platen 20 moves through the bale chute 12. Periodically obstructing the load hopper 14 in this manner prevents the cellulose fiber 11 from continuing to enter the bale chute 12.

The bale press 10 continues to compress batches of the crosslinked fiber 11 until a desired bale length is achieved. The length of the bale is determined by a counting wheel (not shown) wherein rotations of the wheel directly correlate with the length of bale being formed. The counting wheel can be preset to selected bale length values.

As a forming bale 22 passes through the bale chute 12, it engages a plurality of restraints 30 aligned across the opening 24 of the chute. The restraints 30 may be wires or bands or other materials known to be used for restraining bales. As the platen 20 exerts pressure, the restraints 30 are drawn at regular intervals around all edges of the bale 22 as the bale is forced down the chute 12. Once a bale 22 has received sufficient fiber to achieve the preselected length, monitored by rotations of the counter wheel, threaders 32, which travel through slots 34 in platen head 20, are actuated to engage restraints 30 along the backside of the forming bale. The threaders 32, having engaged the restraints 30 along the backside of the bale, thereafter carry the restraints through slots 34 in the face of platen press 20 to the frontside of the bale 22 so that portions of the restraints from the back and the frontsides are aligned with each other.

While maintaining the bale press pressure, the bale restraints 30 are cut to length and the ends are intertwined by a rotating tying head (not shown). Thus the bale is secured by the restraints. The ram 26 is then withdrawn to release the force applied by the platen 20. The resulting bale 22 has a plurality of restraints 30 which enclose the compressed volume of fiber about all side and end faces of the bale. When the force applied produces a second density not exceeding about 0.3 g/cc, the force exerted by the bale on each of the restraints is not greater than about 136 kilograms. With an optimum second density of 0.28 g/cc, the expansion force exerted on each of the restraints is about 113 kilograms.

In this fashion, restrained bales 22 of high-bulk cellulose can be continuously formed having a preselected length and density without substantially altering the bulk and resiliency characteristics of the original cellulose fiber.

Another aspect of the invention is the formation of a group of bales 22 of uniform density for packaging in a transport such as a trailer, shipping container, or rail car. Since the density is low, the volume of the container or other transport must be substantially filled to approach the maximum payload of the transport. The container volume is determined and the bales are densified such that the group will substantially occupy the working volume of a particular transport and will have a total weight that is within the payload limit of the transport. The working volume is the volume of the transport remaining after deducting the minimum volume required for clearance to load the transport, e.g. using a forklift or other conventional equipment with room allocated for pallets if used. Since the volume and payload of transports may vary, it is necessary to taylor the density and length of the bales to satisfy the interior volume and payload limits of various transports. Knowing the transport volume and payload, an optimal-size bale can be specified. The optimal-size bale will not exceed the optimal second density range and the transport volume will be an integral multiple of the bale volume. Then, by appropriately specifying the bale dimensions, the transport working volume can be divided into spaces for an exact number of bales.

More specifically, one can meter a first volume of fiber having a density of about 0.005 g/cc into the bale chute 12 and then compress the fiber to a second (smaller) volume wherein the fiber has a second (increased) density of up to about 1.0 g/cc. The size and density of the bales 22 are selected so that the interior working volume (V) of the transport is an integral multiple (N) of the second volume, and the quantity N times the product of the second density and second volume is substantially equal to the payload limit of the transport. To determine the interior working volume of the transport, it is necessary to make allowance for the space occupied by pallets and the like and the space needed for clearance during loading and unloading. Thus, the transport interior working volume (V) used for the purpose of this calculation is actually somewhat less than the gross interior volume of the transport.

Figure 3:
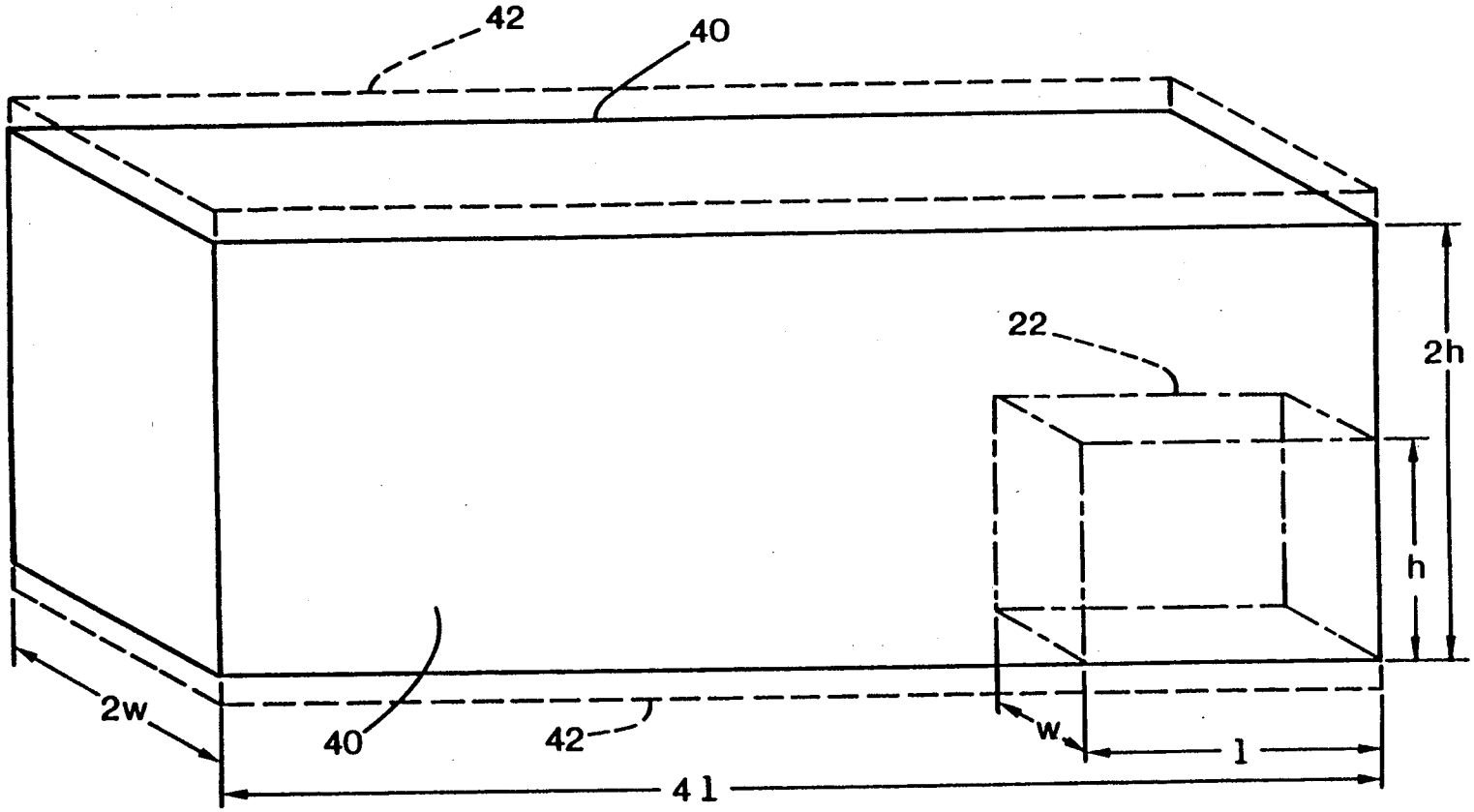
FIG. 3 is a schematic diagram of a transport cargo box and a standard-size bale according to the present invention.

In particular, one starts with the dimensions of the interior "box" of the transport. The dimensions of the box 40 are the gross dimensions of the largest right parallelepiped 42 which will fit within the transport, reduced by the minimum amounts needed for pallets and loading clearance. The height, width, and length of a "standard-size bale" 22 (FIG. 3) are then selected to be small enough for convenient handling and so that each dimension of the box 40 is an integral multiple of the corresponding dimension of the standard-size bale 22. For example, if the height of the bale is "h," the bale is suitable for use in a transport with a box height of "2h", "3h", or higher multiples of h. This ensures that standard-size bales 22 can be used to completely fill the box of the transport.

One then determines the number of standard-size bales 22 needed to fill the box 40. This is accomplished by dividing the volume of the box 40 by the volume of a standard-size bale 22. By dividing the number of standard-size bales 22 into the payload limit, one determines the maximum allowable weight for each standard-size bale 22. The bales 22 are then formed by metering the fiber 11 into a baler that is capable of making bales 22 of the desired dimensions. The amount of fiber is selected to produce a standard-size bale 22 of the maximum allowable weight, provided that the resulting bale will not have a density greater than 1.0 g/cc. If a standard-size bale of the maximum allowable weight would have a density greater than 1.0 g/cc, then the amount of fiber 11 metered into the baler is reduced to an amount which provides a standard-size bale which, after compression to the desired dimensions, has a density no greater than 1.0 g/cc. One can, of course, set a lower maximum density, e.g. 0.3 g/cc, if desired to preserve fiber quality. But, one should not compress fiber into bales smaller than needed such that there is unnecessary space, requiring shoring, within the loaded transport box.

It is not always necessary that all the bales of a load be the same dimensions. Fractionally or multiply dimensioned bales could be used along with standard-size bales. For example, two half length bales could be used in place of a standard-size bale or a doubly-long bale could take the place of two standard-size bales.

As an example, a particular transport may have interior dimensions of 12 meters by 2.3 meters by 2.3 meters (3.5 cubic meters) and a payload limit of 18,200 kilograms. The fiber can be compressed from an initial density of approximately 0.008 g/cc to a second, greater density. Knowing the volume of the particular transport, the transport maximum payload, and the maximum density to which the cellulose fiber is to be compressed, the dimensions of the bales which will effectively satisfy the transport volume, without exceeding the payload, may be determined. For example, 108 of bales (each with a density of 0.28 g/cc and dimensions of 0.67 by 0.77 by 1.15 meters and thereby with a volume of 0.59 $m^3$) will substantially occupy a transport which has a payload limit of 18,200 kilograms and a box volume of 63.5 cubic meters. After the bale has been transported, the restraints are removed whereupon the bale about doubles in volume.

Having illustrated and described the principles of the present invention in a preferred embodiment and variations thereof, it should be apparent to those skilled in the art that the invention can be modified in arrangement and detail without departing from such principles. We claim all modifications coming within the spirit and scope of the following claims.

I claim:

1. A method of applying a force to compress a volume of high-bulk, crosslinked cellulose fiber the method comprising:

introducing high-bulk, crosslinked cellulose fiber at a first density of about 0.008 g/cc into load hopper connected to a bale chute wherein the load hopper funnels the high-bulk fiber into the bale chute; and applying a pressure of no more than about 42.7 $kgs/cm^2$ to compress the fiber into the form of a bale and to extrude the bale through the bale chute, the compressed fiber being at a second density of from about 0.1 g/cc to about 1.0 g/cc.

2. The method of claim 1 comprising applying a force of from about 7 to about 10.5 $kgs/cm^2$.

* * * * *